US011655633B2

(12) United States Patent
McGee et al.

(10) Patent No.: US 11,655,633 B2
(45) **Date of Patent: *May 23, 2023**

(54) STRUCTURAL STUD POST WITH THERMAL BREAK

(71) Applicant: PORTA-FAB CORPORATION, Chesterfield, MO (US)

(72) Inventors: Wayne McGee, Chesterfield, MO (US); Steve Skikas, St. Charles, MO (US); Trace Woodrum, Ballwin, MO (US)

(73) Assignee: Porta-Fab Corporation, Chesterfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/366,817

(22) Filed: Jul. 2, 2021

(65) Prior Publication Data

US 2021/0340759 A1 Nov. 4, 2021

Related U.S. Application Data

(63) Continuation of application No. 16/866,222, filed on May 4, 2020, now Pat. No. 11,053,680.

(51) Int. Cl.
*E04B 2/74* (2006.01)
*E04C 3/04* (2006.01)
(Continued)

(52) U.S. Cl.
CPC ..... *E04B 2/7412* (2013.01); *E04B 1/14* (2013.01); *E04C 2/292* (2013.01); *E04C 2/34* (2013.01);
(Continued)

(58) Field of Classification Search
CPC . E04B 1/14; E04B 2/7412; E04C 3/04; E04C 3/32; E04C 3/34; E04C 2/292; E04C 2003/0452; E04C 2003/0473; Y10S 49/01
See application file for complete search history.

(56) References Cited

U.S. PATENT DOCUMENTS 835,578 A * 11/1906 Tanner ..... 52/838
1,085,429 A * 1/1914 Kahn et al. ..... 217/85
(Continued)

FOREIGN PATENT DOCUMENTS

| | | | |
|---|---|---|---|
| CN | 110725449 | A | 1/2020 |
| JP | 2006249683 | A | 9/2006 |
| WO | 9819025 | A1 | 5/1998 |

OTHER PUBLICATIONS

"International Search Report" for Application No. PCT/US2021/030679, dated Aug. 26, 2021, 3 pages.
(Continued)

*Primary Examiner* — Jessie T Fonseca
(74) *Attorney, Agent, or Firm* — Lewis Rice LLC

(57) ABSTRACT

A structural stud post assembly comprising a center receiver section having opposing receiver channels formed by side walls and angled flanges, and a pair of raceway inserts also defining a raceway channel for accepting wiring and equipment to be disposed in the raceway. The raceways can be installed in the receiver channels to accept and accommodate wiring and equipment. The center receiver comprises a thermal break at about a midpoint to prevent there from being a metal-to-metal thermally conductive pathway through the stud. The structural stud post may be used in the construction of modular building systems.

20 Claims, 3 Drawing Sheets

(51) Int. Cl.

| | |
|---|---|
| ***E04C 3/32*** | (2006.01) |
| ***E04B 1/14*** | (2006.01) |
| ***E04C 2/292*** | (2006.01) |
| ***E04C 2/34*** | (2006.01) |

(52) U.S. Cl.
CPC ..... *E04C 3/04* (2013.01); *E04C 3/32* (2013.01); *E04C 2003/0452* (2013.01); *E04C 2003/0473* (2013.01)

(56) References Cited

U.S. PATENT DOCUMENTS 3,160,245 A * 12/1964 Pavlecka ..... F16B 5/0052 52/693
3,583,118 A 6/1971 Lowery
3,685,222 A 8/1972 Curtess
4,379,480 A * 4/1983 Kempel ..... E06B 3/827 52/784.15
4,435,935 A * 3/1984 Larrea ..... E04F 13/0889 52/471
4,754,587 A * 7/1988 Glaser ..... E04C 2/292 52/282.4
4,936,069 A * 6/1990 Hunter ..... E04C 2/292 52/794.1
5,056,290 A * 10/1991 Alexander ..... E04C 2/292 52/309.3
5,287,675 A * 2/1994 McGee ..... E04B 2/60 52/270
5,414,967 A 5/1995 Cates et al.
6,016,632 A * 1/2000 McGee ..... E06B 3/9636 52/584.1
7,377,082 B1 * 5/2008 Edwards ..... E04C 2/292 52/592.1
7,665,264 B1 * 2/2010 Wolfe ..... E04B 5/023 52/763
9,988,811 B2 * 6/2018 Kalinowski ..... E05D 5/02
2003/0226331 A1 * 12/2003 Lindberg ..... E04C 3/29 52/847

OTHER PUBLICATIONS

"Written Opinion" for Application No. PCT/US2021/030679, dated Aug. 26, 2021, 5 pages.

* cited by examiner

STRUCTURAL STUD POST WITH THERMAL BREAK

CROSS REFERENCE TO RELATED APPLICATION(S)

This Application is a Continuation of U.S. Utility patent application Ser. No. 16/866,222, filed May 4, 2020, and currently pending, the entire disclosure is herein incorporated by reference.

BACKGROUND OF THE INVENTION

Field of the Invention

This disclosure is related to the field of modular structures. In particular, it relates to a structural stud system having a thermal break.

Description of the Related Art

The adoption rate of modular offices and in-plant buildings continues to rise in a variety of industries, ranging from industrial and medical to office settings. Modular structures are generally constructed from vertical modular panels, which serve as walls. These panels may be attached to existing floors, ceilings, or roof decks to form an in-plant structure, or otherwise secured to a solid surface, such as an existing floor system or overhead structural element. Generally, the structures are assembled by chalking out the floor plan for the structure and locating the walls. Next, a floor track is cut to plan and installed by securing it to the substrate (e.g., pavement, building floor, etc.) with a series of anchors.

Next, a plurality of structural stud posts are assembled. Prior art stud posts may be assembled from corresponding stud sections. Prior art stud sections are generally assembled with hardware. An example is shown in prior art FIG. 1. In the depicted prior art embodiment, a structural stud (101) is made by assembling two structural stud sections (103). Each section (103) has a back element (105) connected at two opposing sides to side elements (107) arranged roughly parallel to each other so that the back element (105) and side elements (107) have a U-shaped cross-section. The distal ends of each side element (107) have a flange (109) connected and extending outwardly from each side element (107), generally coplanar with each other. Two such stud sections (103) are assembled back-to-back to form a single structural stud (101). Two opposing flanges (109) on the same side of the assembly (i.e., one flange (109) from each stud section (103)) form a channel (111) for accepting the edge of a wall panel section on each opposing side of the structural stud (101).

The panels (not shown in FIG. 1) are held in place at the bottom by the floor track, and on the sides by the channels (111) formed in the sides of the studs by the flanges (109). A special stud may be used for corners so that the receiving flanges can be disposed to accept two panels at 90 degree angles from one another, as opposed to the planar arrangement shown in prior art FIG. 1. Molding may be installed on the top to secure the panel. The structural stud (101) may then be tightened, and the panels connected via hardware, to further secure the installation.

As can be seen in prior art FIG. 1, the U-shape of the stud sections (103) creates secondary cavities (113) between panels. This cavity (113), referred to in the art as a raceway, can be used to install electrical and communications wiring and related components, such as power switches, receptacles, and network connections, without compromising the integrity of the structural stud (101). For raceways (113) not used, a cover can snap on to cover the raceway and provide an attractive appearance.

One problem with modular structures is the thermal characteristics. By their nature, modular structures have structural studs that functional as building columns to transmit vertical loads to the existing floor system, but whereas the paneling between studs can be manufactured to include insulation, the studs are generally constructed of aluminum or another metal or alloy, which acts as thermal bridge, conducting excess heat as compared to the adjacent insulated elements.

This in turn introduces environmental control challenges, particularly in use cases where careful control of environmental conditions is crucial, or there are high costs associated with managing environmental conditions. For example, a grow room or cleanroom generally requires careful maintenance of temperature, light, and humidity levels, but heat loss (or penetration) through the studs can make this more difficult to manage, and increase costs. It can also introduce air quality or even structural problems by facilitating the introduction of mold, mildew, and rot. Such heat bridges can also exist in corner junctions and in other thermal discontinuities, such as beams that pass through wall assembles and convective bridges in poorly installed insulation systems. However, thermally breaking a structural stud is not a simple exercise because the stud must still retain sufficient structural integrity to serve as a primary load path for axial gravity loads, lateral out-of-plane bending loans, and in-plane seismic loads, while also accommodating the required configuration of panels.

SUMMARY

The following is a summary of the invention in order to provide a basic understanding of some aspects of the invention. This summary is not intended to identify key or critical facets of the invention or to delineate the scope of the invention. The sole purpose of this section is to present some concepts of the invention in a simplified form as a prelude to the more detailed description that is presented later.

Because of these and other problems in the art, described herein, among other things, is a structural stud post assembly having a thermal break comprising: a receiver section having a generally H-shaped central element comprising a center bar and two pairs of parallel legs extending perpendicularly from opposing sides of the center bar, each of the two pairs of legs having a pair of parallel side elements extending perpendicularly outwardly from a distal end of each leg of the each two pairs to form two opposing channels on the opposing sides of the H-shaped central element, and each of the side elements having an angled element attached thereto and extending outwardly therefrom at a first angle, and a thermal break assembly disposed within the center bar; and a raceway section having a generally U-shaped cross section comprising a bottom and two raceway legs, each of the two raceway legs having a proximal end attached to the bottom, and an opposing distal end, each of the two raceways legs extending in parallel from the bottom and having a flange perpendicularly attached to the distal end of each of the two raceway legs, the flanges being coplanar and extending outwardly from the distal ends; wherein the U-shaped cross section is sized and shaped to fit snugly into either of the two opposing channels.

In an embodiment of the structural stud post assembly, the thermal break assembly comprises an insulating structural polymer.

In another embodiment of the structural stud post assembly, the insulating structural polymer is affixed to each of the opposing pairs of parallel legs by an adhesive.

In another embodiment of the structural stud post assembly, the thermal break further comprises a pour channel sized and shaped to accept the insulating structural polymer.

In another embodiment of the structural stud post assembly, each of the opposing pairs of parallel legs are made of a metal, and pour channel comprises a removable metal bridge connecting the opposing pairs of parallel legs, wherein when the removable metal bridge is removed, the structural stud post assembly does not comprise a thermally conductive metal contact path between the opposing pairs of parallel legs.

In another embodiment of the structural stud post assembly, each of the two raceways legs comprises an angled triangular element disposed between the proximal end and the distal end of the legs, the angle triangular element extending outwardly from a midpoint of the U-shaped cross-section.

In another embodiment of the structural stud post assembly, the angled triangular element comprises an outward angled element extending outwardly from the each leg at the first angle.

In another embodiment of the structural stud post assembly, the first angle is about 45 degrees outwardly from the plane of the each leg.

In another embodiment of the structural stud post assembly, the angled triangular element comprises an inward angled element attached to the outward angled element and extending inwardly towards the each leg.

In another embodiment of the structural stud post assembly, the raceway section is generally symmetrical about a center line.

In another embodiment of the structural stud post assembly, the receiver section is generally symmetrical about a center line.

In another embodiment of the structural stud post assembly, the assembly comprises a second raceway section, the second raceway section being generally in the same configuration of the first raceway section.

In another embodiment of the structural stud post assembly, U-shaped cross-section defines a cable raceway sized and shaped to accept wiring, cabling, and electrical and communications equipment and components.

In another embodiment of the structural stud post assembly, the assembly comprises a cover sized and shaped to snap onto the raceway section.

Also described herein, among other things, is a structural stud post assembly with a thermal break comprising: two raceway sections each comprising: a raceway back element having two opposing and generally parallel vertical sides; a pair of opposing, parallel side elements each having a proximal end and an opposing distal end, the proximal end of each of the side elements attached to a corresponding one of the opposing vertical sides, each of the side elements extending generally perpendicularly from the back element, the back element and side elements forming a U-shaped cross section defining a raceway channel; a pair of outwardly angled elements each having a proximal end and an opposing distal end, the proximal end of each of the outwardly angled elements attached to the distal end of a corresponding one of the side elements, each of the outwardly angled elements extending outwardly from the raceway channel; a pair of inwardly angled elements each having a proximal end and an opposing distal end, the proximal end of each of the inwardly angled elements attached to the distal end of a corresponding one of the outwardly angled elements, each of the inwardly angled elements extending inwardly toward the raceway channel; a pair of second side elements each having a proximal end and an opposing distal end, the proximal end of each of the second side elements attached to the distal end of a corresponding one of the inwardly angled elements, each of the second side elements and extending therefrom such that the pair of second side elements are parallel to each other and each of the second side elements is coplanar with a corresponding one of the side elements; and a pair of flange elements each having a proximal end and an opposing distal end, the proximal end of each of the flange elements attached to the distal end of a corresponding one of the second side elements, each of the flange elements extending generally perpendicularly therefrom in opposing directions and the pair of flanges being coplanar; and wherein the back element, the side elements, the outwardly angled elements, the inwardly angled elements, the second side elements, and the flame elements are general in the configuration of an elongated rectangular prism having a length and the length of the back element, the side elements, the outwardly angled elements, the inwardly angled elements, the second side elements, and the flange elements is the same; and a receiver section comprising: a receiver back element having two opposing and generally parallel vertical sides; a pair of opposing, parallel receiver side elements each having a proximal end and an opposing distal end, the proximal end of each of the receiver side elements attached to a corresponding one of the opposing vertical sides, each of the receiver side elements extending generally perpendicularly from the receiver back element, the receiver back element and receiver side elements forming a U-shaped cross section defining a receiver channel; a pair of receiver outwardly angled elements each having a proximal end and an opposing distal end, the proximal end of each of the receiver outwardly angled elements attached to the distal end of a corresponding one of the receiver side elements, each of the outwardly angled elements extending outwardly from the receiver channel; a second receiver back element having two opposing and generally parallel vertical sides, the second receiver back element disposed in parallel to the receiver back element and being connected to the receiver back element by a thermal break assembly disposed therebetween; a second pair of opposing, parallel receiver side elements each having a proximal end and an opposing distal end, the proximal end of each of the second receiver side elements attached to a corresponding one of the second receiver back element opposing vertical sides, each of the second receiver side elements extending generally perpendicularly from the second receiver back element, the second receiver back element and second receiver side elements forming a U-shaped cross section defining a second receiver channel; and a second pair of receiver outwardly angled elements each having a proximal end and an opposing distal end, the proximal end of each of the second receiver outwardly angled elements attached to the distal end of a corresponding one of the second receiver side elements, each of the second outwardly angled elements extending outwardly from the second receiver channel.

In another embodiment of the structural stud post assembly, the thermal break assembly comprises an insulating structural polymer.

In another embodiment of the structural stud post assembly, the insulating structural polymer is affixed to the receiver back element and the second receiver back element by an adhesive.

In another embodiment of the structural stud post assembly, the thermal break assembly further comprises a pour channel sized and shaped to accept the insulating structural polymer.

In another embodiment of the structural stud post assembly, each of the receiver back element and the second receiver back element are metal and the pour channel comprises a removable metal bridge connecting the receiver back element and the second receiver back element.

In another embodiment of the structural stud post assembly, when the removable metal bridge is removed, the structural stud post assembly does not comprise a thermally conductive metal contact path between the receiver back element and the second receiver back element.

DESCRIPTION OF THE PREFERRED EMBODIMENT(S)

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Figure 1:
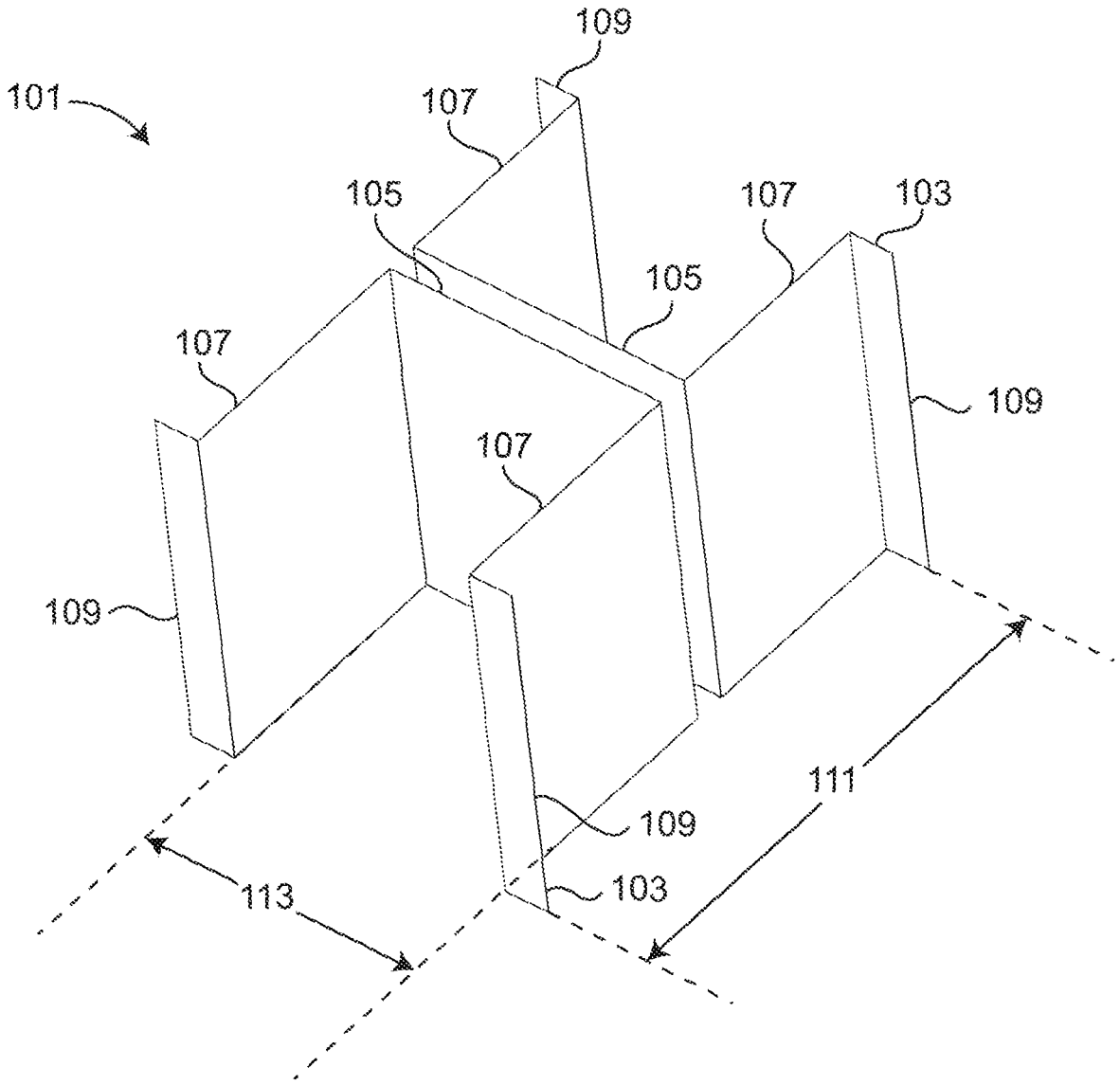
FIG. 1 shows a prior art structural stud post.
Figure 2:
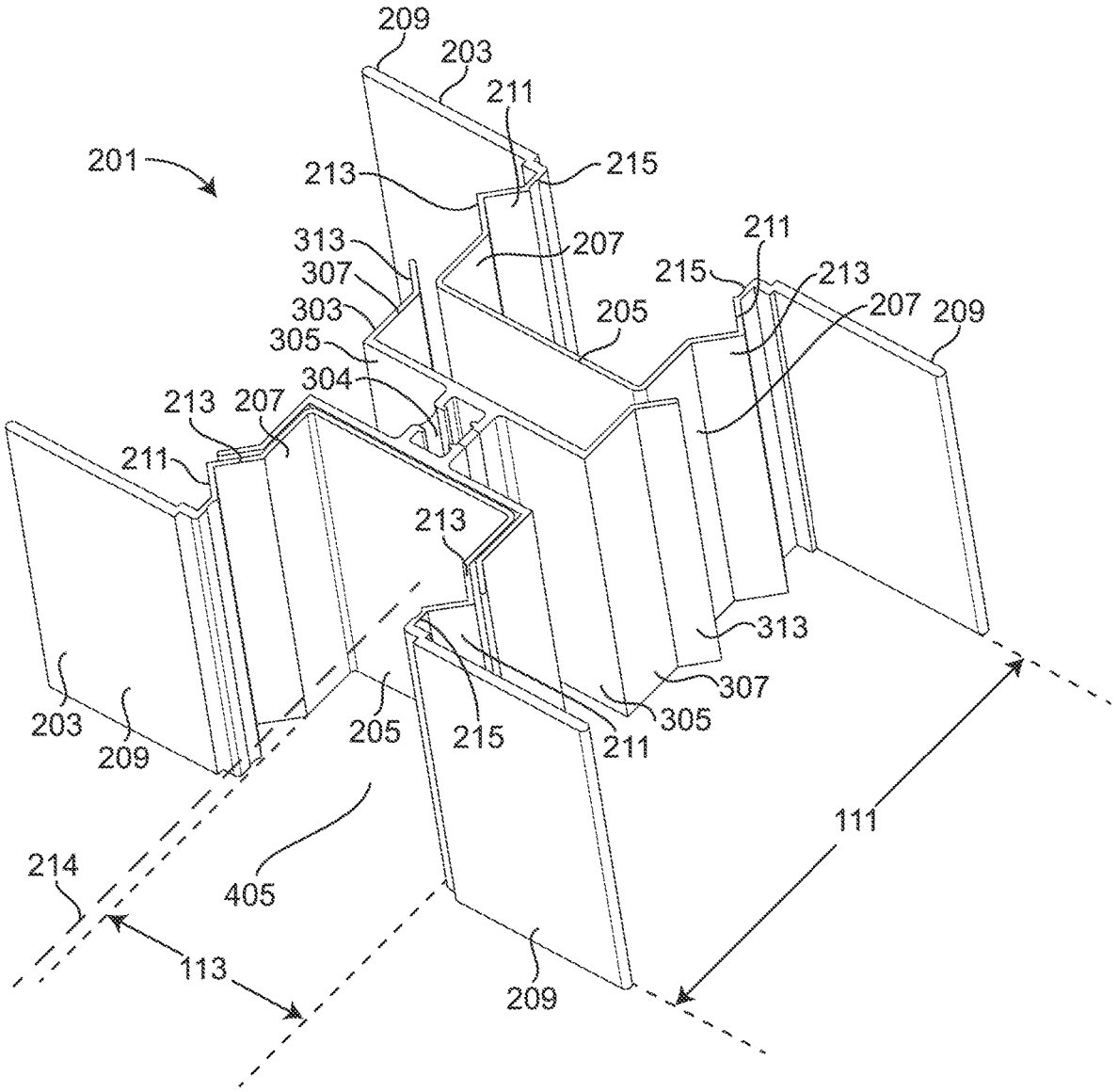
FIG. 2 shows an isometric exploded view of a structural stud post according to the present disclosure.

FIG. 2 depicts an isometric partially exploded view of an embodiment of a structural stud post (201) as described herein. The depicted structural stud post (201) comprises three or more individual members, including a pair of opposing outer raceway sections (203), and an interposed inner receiver section (303).

Each of the depicted outer raceway sections (203) is generally in the same configuration, but is disposed in an opposing or mirrored orientation from each other when assembled. Each depicted outer raceway section (203) comprises a back element (205) attached at its opposing lateral or side edges two opposing side elements (207) extending therefrom, such that the back element (205) and side elements (207) together have a generally U-shaped cross section. The depicted side elements (207) are generally parallel from each other, and generally perpendicular to the back element (205), but this is by no means limiting, and other orientations and arrangements are possible.

Each of the depicted side elements (207) has a proximal end attached to an edge of the back element (205), and an opposing distal end. In the depicted embodiment, each of the distal ends has an interior angled element (213) attached thereto, which flares outwardly from the direction of the midpoint (214) of the outer raceway sections (203). In the depicted embodiment, the angle is approximately 45 degrees, but this is exemplary only and other angles may be used in an embodiment. Each of the interior angled elements (213) has a proximal end attached to the distal end of the corresponding side element (207), and an opposing distal end. In the depicted embodiment, an exterior angled element (211) is attached to the distal end of each interior angled element (213), at an angle effective to cause a distal end of each exterior angled element (211) to be generally coplanar with the plane of the corresponding side element (207). This causes the combination of the interior angled element (213) and exterior angled element (211) to have a generally V-shaped cross section, as shown in FIG. 2. These elements will be understood as each being generally in the configuration of an elongated, thin rectangular prism, generally having a planar appearance extending from the floor track to the ceiling of a structure.

Figure 3:
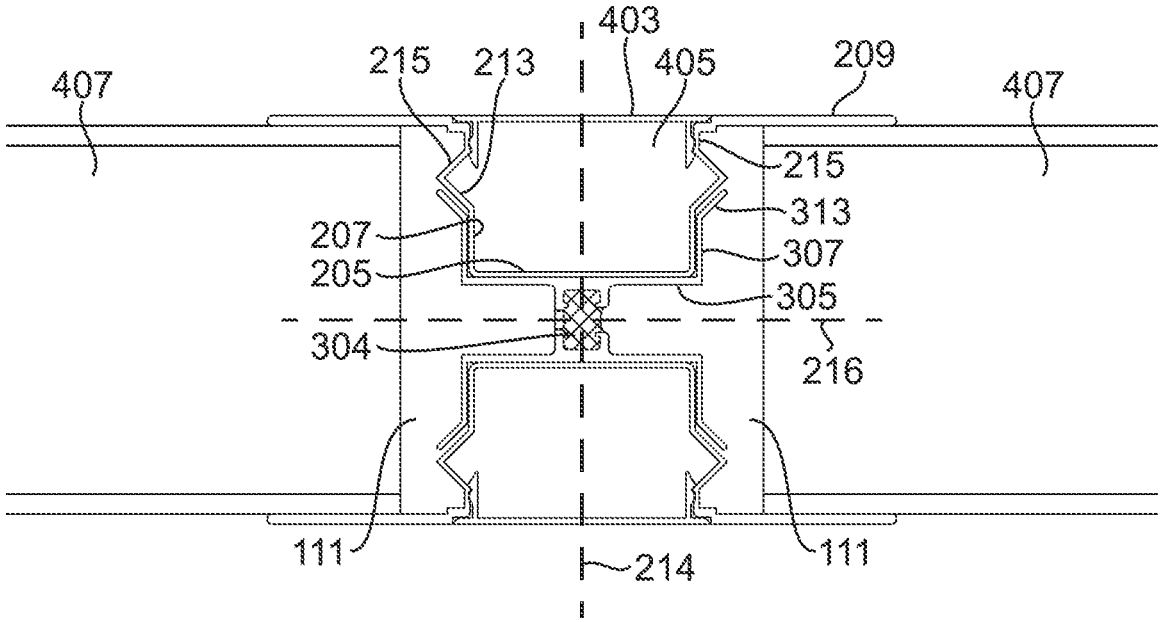
FIG. 3 shows a top-down cross-sectional view of a structural stud post and wall system according to the present disclosure.

The depicted exterior angled elements (211) are attached to the interior angled elements (213) at a proximal end of each exterior angled element (211), and an opposing distal end of each exterior angled element (211) is attached to an exterior side element (215). Each depicted exterior side element (215) is generally coplanar with its corresponding first side element (207). Each of the depicted exterior side elements (215) is attached to the corresponding exterior angled element (211) at a distal end of the exterior angled element (211), and a distal end of each exterior side element (215) is attached to a flange (209). As can be seen in FIGS. 2 and 3, the flange (209) extends outwardly from the midpoint (214) of the outer raceway section (203). The depicted flanges (209) are generally coplanar, generally parallel to the back element (205) and generally perpendicular to the side elements (207) and the exterior side elements (215). Again, this is by no means limiting and other configurations are possible.

The depicted inner receiver section (303) is be comprised of one or multiple components assembled to form a single logical inner receiver section. The depicted inner receiver section (303) is roughly in the configuration of an H. The sides of the H are the back elements (305) of the inner receiver section (303). Each of the depicted back elements (305) is an elongated planar element having a width slightly larger than the width of the back elements (205) of the outer raceway sections (203).

The depicted inner receiver section (303) further comprises a pair of opposing side elements (307) extending from the back elements (305) at opposing lateral ends or side thereof, generally parallel to each other, and generally perpendicular to the back element (305). As can be seen in FIG. 2, this provides a generally U-shaped cross section of the back element (305) and the side elements (307). The dimensions of these elements are slightly larger than those of corresponding structures of the outer raceway sections (203) so that the U-shaped cross section of the back element (205) and side elements (207) fits within the U-shaped formed by the back element (305) and side elements (307) of the inner receiver section (303). Likewise, at the distal ends of the side element (307) a first angled element (313) flares outwardly from the midpoint (214). The angle is generally the same as the angle at which the interior angled elements (213) flare from the side elements (207) of the outer raceway sections (203). This, again, causes the outer raceway sections (203) to fit within the corresponding elements of the inner receiver section (303).

The depicted inner receiver sections (303) contain an opposing pair of these structures; that is, a pair of back elements (305), opposing side elements (307) and opposing first angled elements (313). These elements are disposed in opposing orientations, making the inner receiver section (303) roughly symmetric about a plane (216) bisecting the inner receiver section (303) laterally. In the depicted embodiments, disposed between the back elements (305) of the inner receiver section (303) is a thermal break (304). In the depicted embodiment, the thermal break (304) is formed by walls extending from the back sides of the back elements (305) in the opposite direction from the side elements (307). Thus, the walls forming a thermal break (304) extend towards each other and connect to define a cavity. This cavity may be filled with insulation or other appropriate material for establishing a thermal break.

The thermal break may be formed using any number of techniques known in the art, and/or comprised of any number of different materials known in the art. By way of example and not limitation, in an embodiment, the thermal break may comprise a reinforced polyamide bar disposed between the interior and exterior aluminum profiles, which creates an insulated barrier within the frame. The thermal break may further comprise a material installed in the frame that physically separates the interior portion of the framework from the exterior portion, causing the thermal pathway for heat energy transfer through the wall frame to become "broken." This material is generally be a material that qualifies as having low thermal conductivity as defined by prevailing standards organizations. By way of example and not limitation, the material may be a plastic or non-metallic resin, but in any case, preferably a material having a conductivity of no more than 0.5 W/m.K.

In an alternative embodiment, and pour and de-bridge process may be used. For example, a channel may be formed to encapsulate an insulating material, such as a polymer. The channel may be conditioned to ensure proper adhesion of the insulating material, and then the insulating material is dispensed into the channel having a single bridge between two adjacent components to provide the thermal barrier. The insulating material may be engineered or designed to harden or solidify into a structural polymer. Finally, a mill may be used to remove the bridge and prevent any direct metal-to-metal contact and thereby establish the hardened insulating polymer as a structural thermal barrier.

The sizes, shaped, and dimensions of the various components may be configured or chosen so as to be effective to cause the raceways to be snugly disposed within the channels of the receivers. That is, the corresponding wall elements should generally be in contact, or nearly in contact, with one another with little or no gap between corresponding elements, as shown in, for example, the assembled embodiment of FIG. 3, but the fit is preferably not be so tight as to require an installer to deform the elements to achieve connection.

When the depicted structural stud post (201) is assembled, the corresponding outer raceway sections (203) are connected at their respective back elements (205) to a corresponding back element (305) of the inner receiver section (303). They may be affixed thereto using hardware, adhesive, or other affixation methods known in the art or in the future developed. Once assembled, the four flanges (209) are effectively disposed at opposing and opposite corners of the assembled stud post (201). This causes one of each of the opposing flanges (209) of the outer raceway section (203) to define a retaining channel (111) for the lateral edge of a modular wall segment. Because the assembled structural stud post (201) is symmetric about a middle plane (218), two such channels (111) are formed on opposing sides of the assembled structural stud post (201). Thus, as shown in FIG. 3, two wall segments (407) can be disposed generally coplanar and attached to the assembled structural stud (201).

As can be seen in FIG. 3, each of the outer raceway sections (203) defines a raceway (005) into which wiring, cabling, and/or other electrical and communications equipment or components can be disposed. If the raceway is not used, or is only partially used, a cover (403) can be installed to hide the raceway (405). The cover may be attached via hardware or may be configured to simply snap onto the raceway (405). The embodiment depicted in FIG. 3, is a top-down cross-sectional view of an assembled structural stud post installed in a wall system.

Throughout this disclosure, terms such as "generally," "about," and "approximately" may be used, such as, but not necessarily limited to, with respect to geometric terms, including shapes, sizes, dimensions, angles, and distances. One of ordinary skill in the art will understand that, in the context of this disclosure, these terms are used to describe an attempt by a person of ordinary skill in the art to cause the component in question to be recognizable as conforming to the qualified term. By way of example and not limitation, components described as being "generally coplanar" will be recognized by one of ordinary skill in the art to not be actually coplanar in a strict geometric sense because a "plane" is a purely geometric construct that does not actually exist and no component is truly "planer," nor are two components ever truly coplanar.

Variations from geometric descriptions are unavoidable due to, among other things, manufacturing tolerances resulting in shape variations, defects, imperfections, non-uniform thermal expansion, natural wear, and other deformations. Further, there exists for every object a level of magnification at which geometric descriptors no longer apply due to the nature of matter. Thus, one of ordinary skill in the art will understand how to apply relative terms such as "generally," "about," and "approximately" to describe a reasonable range of variations from the literal geometric meaning of the qualified term in view of these and other context-specific considerations. Additionally, the use of the conjunctive and disjunctive should not necessarily be construed as limiting, and the conjunctive may include the disjunctive, and vice versa.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A wall system comprising:

a structural stud post assembly having a thermal break comprising:

a receiver section having a generally H-shaped central element comprising a center bar and two pairs of parallel legs extending perpendicularly from opposing sides of said center bar, each of said two pairs of legs having a pair of parallel side elements extending perpendicularly outwardly from a distal end of each leg of said each two pairs to form two opposing channels on said opposing sides of said H-shaped central element, and each of said side elements having an angled element attached thereto and extending outwardly therefrom at a first angle, and a thermal break assembly disposed within said center bar; and a raceway section having a generally U-shaped cross section comprising a bottom and two raceway legs, each of said two raceway legs having a proximal end attached to said bottom, and an opposing distal end, each of said two raceways legs extending in parallel from said bottom and having a flange perpendicularly attached to said distal end of each of said two raceway legs, said flanges being coplanar and extending outwardly from said distal ends;

wherein said U-shaped cross section is sized and shaped to fit snugly into either of said two opposing channels; and a pair of wall segments, each wall segment of said pair of wall segments attachable to opposing sides of said structural stud post assembly, once assembled, to be generally coplanar therewith.

2. The wall system of claim 1, wherein said thermal break assembly comprises an insulating structural polymer.

3. The wall system of claim 2, wherein said insulating structural polymer is affixed to each of said opposing pairs of parallel legs by an adhesive.

4. The wall system of claim 3, wherein said thermal break assembly further comprises a pour channel sized and shaped to accept said insulating structural polymer.

5. The wall system of claim 4, wherein each of said opposing pairs of parallel legs are made of a metal, and said pour channel comprises a removable metal bridge connecting said opposing pairs of parallel legs, wherein when said removable metal bridge is removed, said structural stud post assembly does not comprise a thermally conductive metal contact path between said opposing pairs of parallel legs.

6. The wall system of claim 1, wherein each of said two raceways legs comprises an angled triangular element disposed between said proximal end and said distal end of said legs, said angled triangular element extending outwardly from a midpoint of said U-shaped cross-section.

7. The wall system of claim 6, wherein said angled triangular element comprises an outward angled element extending outwardly from each of said two raceway legs at said first angle.

8. The wall system of claim 7, wherein said first angle is about 45 degrees outwardly from the major plane of each of said two raceway legs.

9. The wall system of claim 6, wherein said angled triangular element comprises an inward angled element attached to said outward angled.

10. The wall system of claim 1, wherein said raceway section is generally symmetrical about a center line.

11. The wall system of claim 1, wherein said receiver section is generally symmetrical about a center line.

12. The wall system assembly of claim 1, comprising a second raceway section, said second raceway section being generally in the same configuration of said first raceway section.

13. The wall system of claim 1, wherein said generally U-shaped cross-section defines a cable raceway sized and shaped to accept wiring, cabling, and electrical and communications equipment and components.

14. The wall system of claim 1, further comprising a cover sized and shaped to snap onto said raceway section.

15. A wall system comprising:

a structural stud post assembly with a thermal break comprising:

two raceway sections each comprising:

a raceway back element having two opposing and generally parallel vertical sides;

a pair of opposing, parallel side elements each having a proximal end and an opposing distal end, said proximal end of each of said side elements attached to a corresponding one of said opposing vertical sides, each of said side elements extending generally perpendicularly from said back element, said back element and side elements forming a U-shaped cross section defining a raceway channel;

a pair of outwardly angled elements each having a proximal end and an opposing distal end, said proximal end of each of said outwardly angled elements attached to said distal end of a corresponding one of said side elements, each of said outwardly angled elements extending outwardly from said raceway channel;

a pair of inwardly angled elements each having a proximal end and an opposing distal end, said proximal end of each of said inwardly angled elements attached to said distal end of a corresponding one of said outwardly angled elements, each of said inwardly angled elements extending inwardly toward said raceway channel;

a pair of second side elements each having a proximal end and an opposing distal end, said proximal end of each of said second side elements attached to said distal end of a corresponding one of said inwardly angled elements, each of said second side elements and extending therefrom such that said pair of second side elements are parallel to each other and each of said second side elements is coplanar with a corresponding one of said side elements; and a pair of flange elements each having a proximal end and an opposing distal end, said proximal end of each of said flange elements attached to said distal end of a corresponding one of said second side elements, each of said flange elements extending generally perpendicularly therefrom in opposing directions and said pair of flanges being coplanar; and wherein said back element, said side elements, said outwardly angled elements, said inwardly angled elements, said second side elements, and said flange elements are generally in the configuration of an elongated rectangular prism having a length and said length of said back element, said side elements, said outwardly angled elements, said inwardly angled elements, said second side elements, and said flange elements is the same; and a receiver section comprising:

a receiver back element having two opposing and generally parallel vertical sides;

a pair of opposing, parallel receiver side elements each having a proximal end and an opposing distal end, said proximal end of each of said receiver side elements attached to a corresponding one of said opposing vertical sides, each of said receiver side elements extending generally perpendicularly from said receiver back element, said receiver back element and receiver side elements forming a U-shaped cross section defining a receiver channel;

a pair of receiver outwardly angled elements each having a proximal end and an opposing distal end, said proximal end of each of said receiver outwardly angled elements attached to said distal end of a corresponding one of said receiver side elements, each of said outwardly angled elements extending outwardly from said receiver channel;

a second receiver back element having two opposing and generally parallel vertical sides, said second receiver back element disposed in parallel to said receiver back element and being connected to said receiver back element by a thermal break assembly disposed therebetween;

a second pair of opposing, parallel receiver side elements each having a proximal end and an opposing distal end, said proximal end of each of said second receiver side elements attached to a corresponding one of said second receiver back element opposing vertical sides, each of said second receiver side elements extending generally perpendicularly from said second receiver back element, said second receiver back element and second receiver side elements forming a U-shaped cross section defining a second receiver channel; and a second pair of receiver outwardly angled elements each having a proximal end and an opposing distal end, said proximal end of each of said second receiver outwardly angled elements attached to said distal end of a corresponding one of said second receiver side elements, each of said second outwardly angled elements extending outwardly from said second receiver channel; and a pair of wall segments, each wall segment of said pair of wall segments attachable to opposing sides of said structural stud post assembly, once assembled, to be generally coplanar therewith.

16. The wall system of claim 15, wherein said thermal break assembly comprises an insulating structural polymer.

17. The wall system of claim 16, wherein said insulating structural polymer is affixed to said receiver back element and said second receiver back element by an adhesive.

18. The wall system of claim 17, wherein said thermal break assembly further comprises a pour channel sized and shaped to accept said insulating structural polymer.

19. The wall system of claim 18, wherein each of said receiver back element and said second receiver back element are metal and said pour channel comprises a removable metal bridge connecting said receiver back element and said second receiver back element.

20. The wall system of claim 19, wherein when said removable metal bridge is removed, said structural stud post assembly does not comprise a thermally conductive metal contact path between said receiver back element and said second receiver back element.

* * * * *